US008283305B2

(12) United States Patent
Gonzales et al.

(10) Patent No.: US 8,283,305 B2
(45) Date of Patent: Oct. 9, 2012

(54) CLEANING IMPLEMENT WITH ERODIBLE FOAM SUBSTRATE AND CONTROLLED RELEASE SYSTEM OF ACTIVE AGENT

(75) Inventors: Denis Alfred Gonzales, Brussels (BE); Iris Bogaerts, Mechelen (BE); Vincenzo Tomarchio, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/656,190

(22) Filed: Jan. 22, 2007

(65) Prior Publication Data

US 2007/0161533 A1 Jul. 12, 2007

Related U.S. Application Data

(63) Continuation of application No. PCT/IB2007/050101, filed on Jan. 12, 2007.

(60) Provisional application No. 60/832,645, filed on Jul. 21, 2006.

(30) Foreign Application Priority Data

Jan. 12, 2006 (EP) ..... 06100286

(51) Int. Cl.
*C11D 17/00* (2006.01)
*C11D 9/42* (2006.01)

(52) U.S. Cl. ..... 510/438; 510/221; 510/304.4; 510/317.9

(58) Field of Classification Search ..... 510/438; 428/221, 304.4, 317.9
See application file for complete search history.

(56) References Cited

U.S. PATENT DOCUMENTS

| | | | | |
|---|---|---|---|---|
| 4,209,417 | A * | 6/1980 | Whyte | 510/438 |
| 4,624,890 | A | 11/1986 | Lloyd et al. | |
| 4,828,542 | A * | 5/1989 | Hermann | 604/3 |
| 4,904,524 | A | 2/1990 | Yoh | |
| 6,376,046 | B1 | 4/2002 | Hoshino et al. | |
| 6,498,201 | B1 * | 12/2002 | Corzani et al. | 523/111 |
| 6,716,805 | B1 | 4/2004 | Sherry et al. | |
| 6,790,814 | B1 * | 9/2004 | Marin et al. | 510/101 |
| 7,244,489 | B2 * | 7/2007 | Owensby | 428/310.5 |
| 2001/0031595 | A1 | 10/2001 | Anderson et al. | |
| 2002/0010123 | A1 * | 1/2002 | Schmiedel et al. | 510/446 |
| 2003/0191204 | A1 * | 10/2003 | Hermann et al. | 521/82 |
| 2003/0213500 | A1 | 11/2003 | Mangin et al. | |
| 2005/0153135 | A1 * | 7/2005 | Popplewell et al. | 428/402.2 |
| 2005/0155628 | A1 | 7/2005 | Kilkenny et al. | |
| 2005/0160543 | A1 | 7/2005 | Catalfamo et al. | |
| 2005/0192201 | A1 * | 9/2005 | Cornelio Ford et al. | 510/438 |
| 2005/0202232 | A1 * | 9/2005 | Sauniere | 428/316.6 |
| 2005/0266230 | A1 * | 12/2005 | Hill et al. | 428/317.9 |
| 2005/0276831 | A1 * | 12/2005 | Dihora et al. | 424/401 |
| 2006/0096051 | A1 | 5/2006 | Akai et al. | |

FOREIGN PATENT DOCUMENTS

JP 2003-95815 A 9/2001

* cited by examiner

*Primary Examiner* — David W Wu
*Assistant Examiner* — Thuy-Ai Nguyen
(74) *Attorney, Agent, or Firm* — John T. Dipre; Amy I. Ahn-Roll

(57) ABSTRACT

A cleaning implement comprises an erodible foam substrate, such as a melamine foam substrate and a controlled release system comprising an active agent. The controlled release system comprises a component selected from the group consisting of a polymer matrix, a microcapsule, a particulate porous carrier, a complexing agent, a semi-permeable film and a combination thereof and the active agent is selected from the group consisting of a surfactant, a bleaching agent, a limescale reducing agent, a biocide, a solvent and a mixture thereof.

8 Claims, 1 Drawing Sheet

CLEANING IMPLEMENT WITH ERODIBLE FOAM SUBSTRATE AND CONTROLLED RELEASE SYSTEM OF ACTIVE AGENT

CROSS REFERENCE TO RELATED APPLICATIONS

This application is a continuation of International Application No. PCT/IB2007/050101 filed on Jan. 12, 2007 which claims the benefit of EP Application No. 06100286.1, filed Jan. 12, 2006; and U.S. Provisional Application No. 60/832,645, filed Jul. 21, 2006.

FIELD OF THE INVENTION

The present invention relates to a cleaning implement. More specifically, the present invention relates to a cleaning implement containing an erodible foam substrate, such as a melamine foam substrate.

BACKGROUND OF THE INVENTION

Use of erodible foam, such as melamine-formaldehyde resin foam, referred to herein as melamine foam, and phenolic foam in hard surface cleaning is well known. Indeed, cleaning implements of cut/molded melamine foam are popular for removing soils and/or stains from hard surfaces. Melamine foams are currently marketed in some countries under the tradename of Mr. Clean Magic Eraser™.

Melamine foams show excellent soil and/or stain removal performance in cleaning hard surfaces, when wetted with an appropriate solvent, such as tap water, and is brought into contact with and used to wipe a soiled surface. By "wipe", "wiped" or "wiping" it is meant wiping, swiping, rubbing or the like so as to exert manual force upon a surface to be cleaned. Although melamine foam is generally quite effective in removing soils and/or stains from hard surfaces, consumers still may find it is difficult to remove certain kind of tough stains with melamine foam even though extra rubbing force is applied. For example, common adhesive resin-like or semi-solid denatured oil stains from food, colored stains, such as tea, coffee, fruit juice, grass, and carotenoid stains, permanent marker and ink, mold and mildew, fungus, etc. are often difficult to remove with a plain melamine foam.

To improve the cleaning performance of a sponge, such as melamine foam over certain type of tough stains, one may use a sponge together with a detergent composition. Sponge and detergent can be provided either separately in a kit or the sponge may be impregnated with detergents. However, consumers may still find it inconvenient to apply a detergent composition and then scrub. A sponge impregnated with an active agent tends to release the active agent too quickly, leading to a significant loss of the active agent after the first several uses. Thus, reduced cleaning properties are observed as the active agent is used up. Also, when an active agent releases very quickly in the first or second use, the high level of active agent may require extra rinsing.

Thus, the need exists for an improved cleaning implement which is able to clean tough stains, provide a controlled-release of an active agent and is convenient for use.

SUMMARY OF THE INVENTION

The present invention encompasses a cleaning implement containing an erodible foam substrate and a controlled-release system including an active agent selected from the group consisting of a surfactant, a bleaching agent, a limescale reducing agent, a biocide, a solvent and a mixture thereof.

The present invention further encompasses a method of cleaning a hard surface with a cleaning implement herein.

It has now been surprisingly found that by combining a controlled-release system with an active agent and an erodible foam substrate, the cleaning performance of the cleaning implement on tough hard surface stains is significantly improved. At the same time, the lifetime of the active agent in the cleaning implement is increased and improved cleaning performance is provided over a longer period of time.

DETAILED DESCRIPTION OF THE INVENTION

Figure 1:
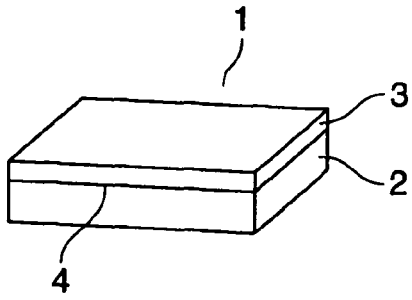
FIG. 1 is a perspective view of an embodiment of the cleaning implement herein with an erodible foam substrate and a second substrate.

All percentages, ratios and proportions herein are "by-weight", all temperatures herein are in degree Celsius (° C.), unless otherwise indicated.

As used herein, "average particle size" means the average particle size by volume of a given particle material determined by conventional analytical techniques such as, microscopic determination.

Cleaning Implement

The cleaning implement herein is an article of manufacture of any suitable shape and/or size and/or volume suitable for cleaning, i.e., removing spots and/or stains from hard surfaces. The cleaning implement herein includes an erodible foam substrate and a controlled release system with an active agent therein. "Erodible foam" herein means foam which crumbles into small particles and peels off by friction. Useful erodible foam herein includes, but is not limited to melamine foam, phenolic foam, etc. In one embodiment herein, the erodible foam is open-cell foam having a density in the range of from about 5 to about 1000 kg/m$^3$, or from about 6 to about 500 kg/m$^3$ or from about 7 to about 300 kg/m$^3$ and a BET surface area in the range of from about 0.1 to about 50 m$^2$/g, preferably from about 0.5 to about 20 m$^2$/g, determined according to DIN 66131. As used herein, "open-cell foam" means foam in which at least 50%, or from about 60% to about 100%, or from about 65% to about 99.9% of all the lamellae are open, determined according to DIN ISO 4590. Said cells can be shaped, e.g. like channels and can have an average pore diameter (number-average) in the range from about 1 μm to about 1 mm, or from about 50 μm to about 500 μm, determined via evaluation of micrographs of sections.

In another embodiment herein, from about 5% to 20%, or from about 10% to 15% by weight of the active agent contained in the cleaning implement presents in the cleaning implement in free form to ensure that active agent is available in the first several uses when active agent in the controlled release system may not yet be sufficiently released. As used in contrast to the controlled release system, "active agent in free form" means that the active agent is supplied to the cleaning implement in its neat form whose release from the cleaning implement is not controlled or sustained on purpose.

Suitable shapes of the cleaning implements herein may be selected from the group consisting of a cubic shape, a rectangular shape, a pyramidal shape, a cylindrical shape, a conic shape, an oblique rectangular prism shape, a cuboid shape, a tetrahedron shape, a sphere shape, a globular shape, and an ellipsoid shape. "Oblique rectangular prism shape" herein means a voluminous body having six walls, wherein three pairs of parallel and equally shaped and sized walls exist and wherein one pair of walls are in the shape of a parallelogram and the remaining two pairs of walls are of rectangular shape.

The cleaning implement may have any thickness and volume appropriate for its intended use. The erodible foam substrate may have a thickness of less than about 30 mm, or from about 2 mm to about 15 mm, or from about 5 mm to about 10 mm and has a total volume of from about 50 $cm^3$ to about 600 $cm^3$, or from about 80 $cm^3$ to about 300 $cm^3$, or from about 150 $cm^3$ to about 275 $cm^3$. Wherein the cleaning implement contains one or more additional substrates, each additional substrate may have any thickness and volume appropriate for its intended use. In one embodiment herein, each additional substrate has a thickness of less than about 30 mm, or from about 2 mm to about 15 mm, or from about 5 mm to about 10 mm. "Thickness" means the length in mm of the side having the smallest extension compared to other sides of the substrate (the height of the substrate). Where the cleaning implement is based on an irregular shape and/or the extension of the thickness of the substrate varies, it is sufficient that at least once the thickness of the substrate extends over the thickness herein.

The erodible foam substrate may be a commercially-available melamine foam substrate, e.g., Basotect™ from BASF. Preparation of melamine foam is known in the art and described, for example in WO 2006/017298. Melamine foam typically has a pore size of from about 20 μm to about 500 μm, or from about 50 μm to about 200 μm. A bead or powder controlled release system can be loaded into the melamine foam substrate by dry-spraying. In such a case, the melamine foam herein may have a bigger pore size than that of the bead or powder, so as to facilitate the penetration of the controlled release system into the melamine foam substrate. According to another embodiment herein, the erodible foam substrate is a phenolic foam substrate.

The cleaning implement herein may include one or more additional substrates, such as a second erodible foam substrate or substrates of a material different from the erodible foam substrate. Such additional substrate(s) may be attached directly to the first erodible foam substrate or to another additional substrate(s). FIG. 1 shows a cleaning implement (1) with a melamine foam substrate (2) and a second substrate (3) attached to the melamine foam substrate (2) by an adhesive attachment (4). The additional substrate may perform a function different from the first erodible foam substrate, for instance to serve as an absorbency substrate, a wiping substrate, a supporting substrate, a scrubbing substrate or a handle substrate. Where the additional substrate is designed as a handle substrate, controlled release system will be loaded into the first erodible foam substrate and expelled from the first erodible foam substrate in use. Hand contact with the active agent can be minimized by holding only the handle substrate. Preferably, an indicia, such as a different color, a marking, a word, etc. is included to guide a user to hold the handle substrate and contact the surface to be cleaned with the first erodible foam substrate.

Where the additional substrate(s) is not an erodible foam substrate, the additional substrate can be made from a cellulose foam sponge, a naturally occurring sponge or a nonwoven, or even a foam of a polymer comprising a monomer selected from the group consisting of a urethane, a propylene, an ethylene, a vinyl acetate, an ester, an acrylate, an ether and a mixture thereof, such as polyurethane, polypropylene, polyethylene, polyvinyl acetate, polyester, polyurethane-ether, polyurethane-ester, polyethylene-vinylacetate, polyethylene-methacrylate, etc. The second substrate may be a hydrophilic ester polyurethane foam, such as Cellulex™ from Foamex L.P., capable of absorbing liquids, but do not swell appreciably. See U.S. Pat. No. 6,756,416.

The additional substrate may be more hydrophobic than the melamine foam and used as a handle substrate. Exemplary hydrophobic substrates include closed-cell foam of a polymer having a monomer selected from the group consisting of a urethane, a propylene, an ethylene, a butadiene, a styrene, vinyl acetate, a silicon, an ester, an acrylate, an ether, cellulose acetate, styrene, silicon, natural latex, rubber, vinylchloride, fluoroethylene and a mixture thereof, available as Plastazote™, Evazote™, Supazote™, Propazote™ from Zotefoams plc (Croydon, UK) and FR, FM, CN or SD foam grade made with a significant fraction of hydrophobic polymer/materials.

Figure 2:
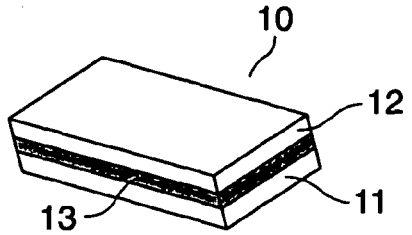
FIG. 2 is a perspective view of an embodiment of the cleaning implement herein with three substrate layers in a oblique rectangular prism-like shape.

FIG. 2 shows a cleaning implement (10) with three layers of substrate in a sandwiched configuration having an oblique rectangular prism shape, wherein at least one of the two outside substrates (11) and (12) is a melamine foam substrate. The middle substrate (13) is a liquid-impermeable substrate and the controlled release system is contained in one of substrates (11) and (12). For example, the controlled release system containing an active agent may be loaded only into substrate (12), and the middle substrate (13) is a liquid-impermeable substrate. In this case, active agent is released only from substrate (12), substrate (11) can be used as a handle substrate. Materials useful as a liquid-impermeable substrate are known, such as the hydrophobic foam substrates described above or high barrier hydrophobic nonwoven or plastic film, such as polyethylene, polypropylene, polyamide, polyester, Teflon™, etc.

Where the cleaning implement herein includes more than one substrate or a semi-permeable film, the erodible foam substrate, the semi-permeable film and the additional substrate(s) may be attached by any attachment suitable for joining the substrates and films. The attachment may be either permanent (wherein the two substrates cannot be separated without inflicting substantial damage to the substrates) or temporary (wherein the two substrates may be separated without inflicting substantial damage to the substrates) as desired. Suitable permanent attachments include permanent adhesive, foam flame lamination, sewing or needle-punching the substrates and/or films together, and a combination thereof. The substrates or films can also be joined together by a permanent adhesive. Useful adhesives include vinylic emulsions, such as those based on vinyl acetate or other vinyl esters, such as homopolymers and copolymers of ethylene and/or acrylic monomers (vinyl acrylics); homopolymers or copolymers of acrylic emulsions; a cross-linked adhesive including those created by including a reactive co-monomer (e.g., a monomer containing carboxyl, hydroxyl, epoxy, amide, isocyanate, etc. functionality) which are capable of cross-linking the polymer themselves (e.g. carboxyl groups reacting with hydroxyl, epoxy or isocyanate groups) or by reaction with an external cross-linker (e.g. urea-formaldehyde resin, isocyanates, polyols, epoxides, amines and metal salts, especially zinc). The adhesives herein can also include limited quantities of tackifying resins to improve adhesion, such as the addition of hydrogenated rosin ester tackifier to vinyl acetate/ethylene copolymer latex. See also the adhesive compositions in U.S. Pat. No. 5,969,025. Adhesives can be applied by, for example, spray coating to give a discontinuous attachment, curtain coating, roll coating, slot coating or lick coating to give a continuous attachment.

A suitable temporary attachment includes a weak adhesive, such as low peel force adhesive, repositionable adhesive, such as "PSA" (Pressure Sensitive Adhesive) having permanent tacks (some also called softgel or hydrogel adhesive, such as Dispomelt™ available from National Starch); a hook-and-loop fastening system (e.g. Velco™); a water-based, water-soluble coating or adhesive; an interlocking substrate shape that provides stability and an interlocking fit, and a combination thereof.

Referring to FIG. 1, the controlled release system has an active agent in the adhesive attachment (4). In another embodiment, the adhesive attachment (4) is liquid-impermeable and the controlled release system with an active agent is contained in the melamine foam substrate (2). In this case, active agent is released only from substrate (2), thus, second substrate (3) can be used as a handle substrate. Useful liquid-impermeable adhesive materials include PM17 and LA hotmelt from Savare (Milano, Italy), Propel™, SolarCure™, Optimelt™, Clarity™, Fullback™ hotmelts from Fuller (Minnesota, USA), Fulaprene, Bondseal solvent adhesive from Fuller, and Rakoll™, AirSperse™, LiquiLoc™, Casemate™, water-based adhesives from Fuller, etc.

Controlled Release System

The controlled release system herein contains an active agent and is in communication with the erodible foam substrate. The controlled release system can be impregnated or dispersed inside the erodible foam substrate, applied onto the attachment attaching the substrates and/or applied in-between a semi-permeable film and a second film attached to the erodible foam substrate. Exemplary controlled release systems useful herein include those having a polymer matrix, a microcapsule, a particulate porous carrier, a complexing agent, and/or a semi-permeable film. The controlled release system herein can be a liquid, a gel, a paste, a bead, a powder or a film, etc. and can be applied to the cleaning implement by any conventional means, such as dipping, spraying, dousing, coating, etc. Where the controlled release system is a bead or powder, the bead or powder may be deposited or dry-sprayed onto the substrate while vibrating the substrate to permit a better penetration of the bead or powder inside the substrate. Preferably, the average particle size of the bead or powder is less than the average pore diameter of the melamine foam substrate, i.e. the average particle size of the controlled release system is from about 1 μm to about 400 μm, or from about 10 μm to about 100 μm, or from about 10 μm to about 30 μm. Where the controlled release system comprises a semi-permeable film, it can be attached to the substrate by an adhesive.

The controlled release system may further comprise a plasticizer, a tackifier, solid organic or mineral filler, and/or a preserving agent. These materials may provide some further advantages, such as binding the substrates or films together, facilitating the immobilization of the controlled release system inside the substrate, further controlling the release of the active agent, etc.

Suitable plasticizers include citric acid esters, such as acetyltributylcitrate and triethylcitrate, low molecular weight polyesters, polyethers, liquid rosin esters (e.g. Foralyn™ 5020F), aromatic sulphonamides, phthalates, benzoates, sucrose esters, diacetin, polyfunctional alcohols derivatives, adipates, tartrates, sebacates, esters of phosphoric acid, fatty acids and diacids, fatty alcohols and diols, epoxidized vegetable oils and mixtures thereof.

Tackifiers are used in hot-melt adhesives to improve adhesive properties and are in general organic compounds with polycyclic structures. Tackifiers are thermoplastic materials, stable at about 200° C., amorphous glassy at room temperature, and have a $T_g$ higher than about 50° C., or from about 80° C. to about 125° C. and a molecular weight of from about 500 Daltons to about 2000 Daltons. The tackifier may be a rosin or its derivative which is solid at room temperature, such as alpha-methylstyrene copolymer available as Kristalex™ from Hercules with a mean molecular weight of about 1200 When present, the tackifier will represent from about 2% to about 60%, or from about 5% to about 40% by weight of the controlled release system.

Suitable solid organic or mineral fillers can be oxides, chlorides, sulfates, phosphates, carbonates of Mg, Mn, Ba, Ca, W, Zr, Ti, Si, Mo, in particular $TiO_2$, $SiO_2$ and $Al_2O_3$. Further suitable materials are water-insoluble sodium polymetaphosphate, hydrated alumina, dicalcium orthophosphate dihydrate, calcium pyrophosphate, tricalcium phosphate, calcium polymetaphosphate.

The amount of the controlled release system in the cleaning implement may vary widely due to a variety of factors including capacity of the erodible foam and any additional substrate(s) to absorb the controlled release system, viscosity of the controlled release system, etc. In one embodiment herein, the cleaning implement contains from about 0.1-500 parts, or from about 0.5-100 parts, or from about 1-50 parts by weight of the controlled release system per 100 parts by weight of the erodible foam substrate.

Polymer Matrix

In one embodiment herein, the controlled release system comprises a polymer matrix and an active agent. The active agent is absorbed or dissolved in the polymer matrix or chemically linked to the polymer matrix. Weight ratio of the polymer matrix to the active agent is from about 19:1 to about 1:19, or from about 3:2 to 2:3. The controlled release system comprising polymer matrix and active agent may be prepared by any known process for manufacturing thermoplastic polymeric compositions and will typically comprise steps of melting the polymer, homogenously blending the plasticizer and/or tackifier, if present, and the active agent to form a homogenous mass which is then cooled to give the controlled release system. Preferred polymer matrix has low melt temperature and viscosity and therefore is suitable for use as hot melts. The controlled release system may also be prepared using a polymer solution. Typical steps include dissolving the polymer, tackifier and/or plasticizer, if present and active agent in an effective solvent, heating, if necessary to prepare a solution or a gel and eliminating the solvent by evaporation. Alternatively, the controlled release system may be prepared in the form of an aqueous emulsion or dispersion.

The active agent can be released from the controlled release system via migration, water activation before use, degradation, such as hydrolysis of the weak chemical bond linking the active agent and the polymer matrix, and/or mechanical erosion of the polymer matrix by friction. Polymers useful as the polymer matrix herein include thermoplastic hydrophilic polymers, water-soluble polymers, water-swellable polymers, polymers erodible by mechanical friction, polymers comprising at least one primary and/or secondary amine group, nanoparticle polymers comprising cationic monomers. "Water-soluble polymers" herein refers to polymers whose solubility in water (pH is 7, 25° C.) is more than 1.5 g/l, preferably more than 2 g/l. "Water-swellable polymers" herein refers to polymers having a water uptake at 20° C. of at least 10% by weight, or at least 20% by weight, measured according to ISO 8361.

Polymers useful herein can be those having a monomer selected from the group consisting of an olefin, an acrylic acid, an acrylate, an ether, a vinyl alcohol, a vinyl pyrrolidone, a urethane, a siloxane, a saccharide, an ethylene imine, an amide, an ester, and/or a vinyl acetate and may have a molecular weight (Mn) in the range from 500 to 1,000,000 g/mol, or from 1,500 to 500,000 g/mol, or from 2,000 to 200,000 g/mol, or up to 20,000 g/mol, determined, for example, by gel permeation chromatography (GPC).

Suitable thermoplastic hydrophilic polymers are disclosed in WO 99/64077, WO 99/64505 and EP 1193289. Particularly preferred thermoplastic hydrophilic polymers are thermoplastic ethylene-vinyl acetate copolymer (e.g. Elvax™ 250 from Dupont, a random ethylene-vinyl acetate copolymer resin with 28% by weight of vinyl acetate and 72% by weight of ethylene), thermoplastic poly-ether-amide block copolymers (e.g. Pebax™ MH1657 from Atofina, a polyethylene oxide-block co-poly-ϵ-caprolactam polymer, each block has Mw of about 1500 g/mol. Melting point: 204° C. according to ASTM D3418), thermoplastic polyester block copolymers (e.g. Hytrel™ 8171 from Dupont, a hydrophilic butylenes/polyethylene glycol phthalate block copolyester), thermoplastic polyurethanes, typically non-reactive polyurethanes (e.g. Estane™ 5170 from Noveon, a polyethylene glycol block polyurethane) and mixtures thereof.

Suitable water-soluble or water-swellable polymers can be polyethylene glycols (polyethylene oxide) which are solid at room temperature (e.g. Pluriol™ E9000 having Mw of about 9000 g/mol and Pluriol™ E400 having Mw of about 400 g/mol), polyvinyl pyrrolidone, polyvinyl alcohol and partially hydrolyzed polyvinyl acetate, polyacrylamide, polysaccharide, such as agar, dextran, guatti gum, acacia, guar, starch, etc., polynucleotide, polypeptide (polyglutamic), polyacrylate, crosslinked polyacrylate, physically crosslinked polyethylene oxide, such as Aquacalk™ from Sumitomo, polyalkyleneglycol-vinylacetate graft copolymers, copolymers of (meth)acrylic acid and (meth)acrylates, such as $C_{1-10}$ alkyl esters of (meth)acrylic acid and copolymers of (meth)acrylic acid and ethylenic unsaturated dicarboxylic acids, such as fumaric acid, itaconic acid, and particularly maleic acid.

Suitable erodible polymers can be waxes. Examples of waxes are natural waxes, such as paraffin wax, microcrystalline wax, bio-wax, such as lanolin, candellila, carnauba, mineral wax, such as montane wax, and synthetic wax, such as polyethylene wax with an average molecular weight (Mn) in the range of 500 to 20,000 g/mol, and polypropylene wax with an average molecular weight (Mn) in the range of 500 to 20,000 g/mol.

Suitable nanoparticle polymers comprising cationic monomers may contain from about 0.1% to about 50%, or from about 1% to about 10% by weight of cationic monomers and having a particle size of from about 100 nm to about 50 μm. The cationic monomers useful herein comprise a cationic unit. A cationic unit is understood to mean a moiety which when incorporated into the structure of the polymeric particle is capable of maintaining cationic charge within the pH range of from about 2 to about 8. The cationic unit is not required to be protonated at every pH value within the range of about 2 to about 8. Suitable cationic monomers include dimethylamino alkyl acrylates, especially dimethylaminoethyl methacrylate, vinyl pyrrolidones, vinyl imidazoyls, vinyl ethers having dialkyl amino groups, vinyl pyridines, alkyl acrylamides, dialkyl acrylamides, dialkylamino alkyl acrylamide, and amino alkyl acylamides.

Suitable polymers comprising at least one primary and/or secondary amine group can be a linear homo-, co-polymer and optionally branched, grafted and/or cross-linked polymer. Preferably, these polymers comprise more than 10 amino groups and have a number average molecular weight (Mn) ranging from about 150 to about 2.10E6, or from about 600 to about 40,000. Examples of such polymers include polyethylene imine commercially available as Lupasol™ from BASF, polyvinyl amine, polyvinyl amine-vinyl alcohol copolymer, polyvinyl amine-vinyl formamide copolymer, polyamino acid (L-lysine/lauric acid in a molar ratio of 10:1, L-lysine/aminocaproic acid/adipic acid in a molar ratio of 5:5:1, L-lysine/aminocaproic acid/ethylhexanoic acid in a molar ratio of 5:3:1), polylysine-cocaprolactam, polylysine hydrobromide, cross-linked polylysine, amino substituted polyvinyl alcohol.

In one embodiment herein, the polymer matrix is a polyalkyleneglycol-vinylacetate graft copolymer having an average molecular weight (Mn) of from 3,000 to 100,000 g/mol. Examples of the polyalkyleneglycol-vinylacetate graft copolymer can be made from a base polymer (A) selected from:

(A1) polyethylene glycols, which may be capped with one or two $C_{1-25}$ alkyl groups, or uncapped polyethylene glycols, having an average molecular weight Mn in the range of from 1,500 to 20,000 g/mol, or from 2,500 to 15,000 g/mol;

(A2) copolymers of ethylene oxide and propylene oxide and/or butylene oxide with an ethylene oxide content of at least 50% by weight, capped with one or two $C_{1-25}$ alkyl groups, or uncapped, having an average molecular weight Mn in the range of from 1,500 to 20,000 g/mol, or from 2,500 to 15,000 g/mol;

(A3) chain extended products obtainable by conversion of polyethylene glycols (A1) or copolymers of ethylene oxide and propylene oxide and/or butylene oxide (A2) with $C_{2-12}$ dicarboxylic acids or $C_{2-12}$ dicarboxylic acid (m)ethyl esters or $C_{6-18}$ diisocyanates. Particularly preferably, chain extended products (A3) have an average molecular weight Mn in the range of from 2,500 to 25,000 g/mol.

To graft any of the base polymers (A1) to (A3), vinyl esters, such as vinyl acetate or vinyl propionate are preferred. In one embodiment herein, vinyl esters are the sole monomer for grafting. In another embodiment herein, 1 to 50 mol % of vinyl ester is replaced by (meth)acrylic acid.

Microcapsule

In one embodiment herein, the controlled release system includes a microcapsule encapsulating an active agent. The microcapsule can be any ruptureable capsule containing an active agent therein or capsule which is controllably penetrable by the active agent encapsulated therein. The rupture strength of the microcapsules should be within a range that can endure handling and spraying without rupturing and yet break by an external force of friction or moisture.

Shell of the microcapsules can be made from a wide variety of materials known in the art. Suitable microcapsule shell materials and/or methods for making microcapsule are disclosed in, e.g., U.S. Pat. Nos. 2,800,458; 3,159,585; 3,516,846; 3,516,941; 3,533,958; 3,697,437; 3,778,383; 3,888,689; 3,965,033; 3,996,156; 4,010,038; 4,016,098; 4,087,376; 4,089,802; 4,100,103; 4,251,386; 4,269,729; 4,303,548; 4,460,722; 4,610,927; and 5,591,146; UK Patent Nos. 1,156,725; 1,483,542; 2,006,709; 2,041,319; 2,048,206 and 2,062,570; and Benita, Simon (ed.), Microencapsulation: Methods And Industrial Applications (Marcel Dekker, Inc. 1996).

Microcapsule herein has an average size of from about 0.1 μm to about 1,000 μm, or from 1 μm to about 500 μm, or from about 10 μm to about 100 μm. The active agent is contained in the microcapsule at a level of from about 1% to about 99%, or from about 10% to about 95%, or from about 30% to about 90%, by weight of the microcapsule.

Particulate Porous Carrier

In one embodiment herein, the controlled release system contains a particulate porous carrier, and the active agent is releasably loaded into the pores of the carrier. The particulate porous carrier absorbs the active agent and then releases it either over an extended period of time or as a result of external pressure, moisture, etc. The particulate porous carrier is typically selected from silica, silicate, clay, metal oxides, zeolite, sodalite, chitin micro bead, carboxyalkylcellulose, starch, sugar, porous carbon, and/or their derivatives. Preferably, the particulate porous carrier is Zeolite A having a primary particle size of from about 0.1 μm to about 10 μm.

A typical method for loading an active agent into a particulate porous carrier includes the steps of spraying an active agent or a solution of an active agent onto the particulate porous carrier followed by stirring the solid mixture or suspension to obtain the active agent-loaded particulate porous carrier. Alternatively, one may deposit the particulate porous carrier onto the substrate and then spray the active agent or a solution of the active agent onto the substrate. The weight ratio of the particulate porous carrier to the active agent is from about 100:1 to 1:1, or from about 100:20 to 100:60.

Complexing Agent

In one embodiment herein, the controlled release system comprises a complexing agent binding an active agent. Useful complexing agent can be cyclodextrin.

Both natural or chemically modified cyclodextrin, such as α-, β-, and γ-cyclodextrin, glucosyl-α-cyclodextrin, maltosyl-α-cyclodextrin, glucosyl-β-cyclodextrin, and maltosyl-β-cyclodextrin can be used herein. Polymerized cyclodextrin may also be used and may form a complex with the active agent. Suitable solubility of the cyclodextrin/active agent complex in water is from about 0.1 g to about 100 g, or from about 0.5 g to 20 g, or from about 1 g to 5 g of complexes per 100 g water at 25° C. In one embodiment herein, the cyclodextrin is a β-cyclodextrin having a water solubility of about 1.8 g to about 2 g per 100 g water at 25° C. Same method for loading an active agent into a particulate porous carrier as described above can be used for binding cyclodextrin with an active agent. In one embodiment herein, the molar ratio of cyclodextrin to the active agent is from about 20:1 to about 1:1 mol equivalent, or from about 10:3 to about 10:8 mol equivalent.

Semi-Permeable Film

Figure 3:
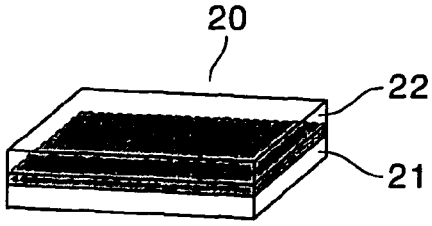
FIG. 3 is a perspective view of an embodiment of the cleaning implement herein with a second substrate and two layers of semi-permeable films.
Figure 4:
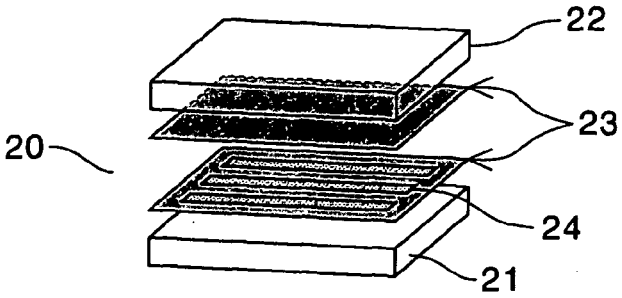
FIG. 4 is an exploded view of the cleaning implement shown in FIG. 3.

The controlled release system may contain a first semi-permeable film attaching to the erodible foam substrate, a second film of a semi-permeable film or a liquid-impermeable film attaching to a second substrate, and an active agent applied in-between the first semi-permeable film and the second film. Active agent can be used in its neat form, or in a form of any of the controlled release system herein. FIG. 3 and FIG. 4 show a cleaning implement (20) with a melamine foam substrate (21), a second substrate (22), and two layers of semi-permeable film (23) laminated together and attached to the melamine foam substrate (21) and the second substrate (22) separately. An active agent (24) is applied in-between the two semi-permeable films (23).

Suitable semi-permeable films herein include flexible liquid-impermeable films having open pores, such as polyolephin films based on polyethylene and polypropylene, polyester, polyamide, polyester-ether copolymer, polyamide-ether, Teflon™ films, etc. These films typically have a basis weight of 1-250 g/m$^2$, or 2-60 g/m$^2$. Semi-permeable films are commercially available from Clopay, RKW, Mitsui, Tacolin, 3M, Dupont, International plastic, etc. Pore size and pore density (number of pores per square meter of films) can be adjusted to tailor the release kinetics of the active agent through the pores. Typically, the pore size is from about 100 μm to about 10 mm, or from about 0.5 mm to about 2 mm, and the pore density is from about 100 pores/m$^2$ to about 500,000 pores/m$^2$, or from about 3000 pores/m$^2$ to about 30,000 pores/m$^2$. Microporous film is generally defined by their water vapor permeability (WVTR) as measured, for instance by PERMATRAN-W™ Model 398 from Mocon (e.g.: ASTM Standard E-398). Suitable microporous film has a WVTR of from about 100 to about 25,000 g/m$^2$/day, or from about 2000 to about 6,000 g/m$^2$/day. Other suitable semi-permeable film is high liquid-barrier nonwoven containing a high fraction of fibers made of hydrophobic material. Typical high liquid-barrier nonwoven has a basis weight of 1-500 g/m$^2$, or from 10-150 g/m$^2$, or from 40-80 g/m$^2$. Preferable high liquid-barrier nonwoven is made of 100% of polypropylene fibers and formed by spunbond (S), meltblown (M), and combinations thereof, such as SMS, SMMS, etc. High liquid-barrier nonwoven is commercially available from BBA, PGI, Freudenberg, Alsthom, Jacob holm, etc.

Active Agent

The cleaning implement herein contains an active agent selected among a surfactant, a bleaching agent, a limescale reducing agent, a biocide, a solvent and a mixture thereof.

Surfactants can be nonionic, anionic, cationic, amphoteric and/or a zwitterionic surfactant. Suitable nonionic surfactants include alkoxylated fatty alcohol having the formula of RO(EO)e(PO)pH, where R is a hydrocarbon chain of from 2 to 24 carbon atoms, EO is ethylene oxide and PO is propylene oxide, e and p respectively e presenting the average degree of ethoxylation and propoxylation, are independently from 0 to 24, or R is a straight alkyl chain having from 6 to 22 carbon atoms, e is 5-12 and p is 0. Suitable cationic surfactants herein include derivatives of quaternary ammonium, phosphonium, imidazolium and sulfonium compounds. Preferred cationic surfactants herein are trimethyl quaternary ammonium compounds. Suitable amphoteric surfactants herein include amine oxides, betaine or ammonium sulfate or ammonium carboxylate, having the following formula $R_1R_2R_3NO$, $R_1R_2R_3NR_4SO_4$ or $R_1R_2R_3NR_4CO_2$ wherein each of $R_1$, $R_2$ and $R_3$ is independently a saturated substituted or unsubstituted, linear or branched alkyl groups of from 1 to 30, or from 8 to 18 carbon atoms, except for $R_4$ which preferably contain 3 saturated carbons. Preferred amine oxides herein are for instance natural blend $C_8$-$C_{10}$ amine oxides, and $C_{12}$-$C_{16}$ amine oxides, such as cetyl dimethyl amine oxide. Preferred betaine herein is cocamidopropyl betaine and lauramidopropyl betaine. Suitable anionic surfactants include alkyl diphenyl ether sulphonate and alkyl carboxylate. Other suitable anionic surfactants herein include water soluble salts or acids of the formula $ROSO_3M$ wherein R is preferably a $C_{10}$-$C_{24}$ hydrocarbyl, or $C_{12}$-$C_{18}$ alkyl or hydroxyalkyl, and M is H or a cation, such as sodium, potassium, lithium, or ammonium or substituted ammonium. Other suitable anionic surfactants include soap salts, $C_9$-$C_{20}$ linear alkylbenzenesulfonates, $C_8$-$C_{22}$ primary or secondary alkylsulfonates, sulfonated polycarboxylic acids, $C_8$-$C_{24}$ alkylpolyglycolethersulfates (containing up to 10 moles of ethylene oxide); alkyl ester sulfonates, sulfates of alkylpolysaccharides, alkyl polyethoxy carboxylates, such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable. Further examples are given in "Surface Active Agents and Detergents" (Vol. I and II by Schwartz, Perry and Berch). A variety of such surfactants are also generally disclosed in U.S. Pat. No. 3,929,678.

Bleaching agent herein is selected from a hydrogen peroxide source, a preformed peroxycarboxylic acid, a hypohalite bleach source and a mixture thereof. Hydrogen peroxide sources herein include persulfate, dipersulphate, persulfuric acid, percarbonate, perborate, metal peroxide, perphosphate, persilicate, urea peroxyhydrate and a mixture thereof. Preformed peroxycarboxylic acids herein include those containing one, two or more peroxy groups, and can be aliphatic or aromatic. When the organic percarboxylic acid is aliphatic, the unsubstituted acid suitably has the linear formula: HO—O—C(O)—$(CH_2)_n$—Y, wherein Y is H, $CH_3$, $CH_2Cl$, COOH or C(O)OOH; n is an integer of 1-20. Branched analogs are also acceptable. When the organic percarboxylic acid is aromatic, the unsubstituted acid suitably has formula: HO—O—C(O)—$C_6H_4$—Y wherein Y is hydrogen, alkyl, alkyhalogen, halogen, —COOH or —C(O)OOH. Monoperoxycarboxylic acids useful as oxygen bleach herein are further illustrated by alkyl percarboxylic acids and aryl percarboxylic acids such as peroxybenzoic acid and ring-substituted peroxybenzoic acids, e.g., peroxy-α-naphthoic acid; aliphatic, substituted aliphatic and arylalkyl monoperoxy acids such as peroxylauric acid, peroxystearic acid, and N,N-phthaloylaminoperoxycaproic acid (PAP); and 6-octylamino-6-oxo-peroxyhexanoic acid. Peracids can be used in acid form or any suitable salt with a bleach-stable cation. Suitable hypohalite bleaching agents herein include those that form positive halide ions and/or hypohalite ions, and bleaching agents that are organic based sources of halides, such as chloroisocyanurates. Suitable hypohalite bleaching agents herein include alkali metal and alkaline earth metal hypochlorite, hypobromite, hypoiodite, chlorinated trisodium phosphate dodecahydrate, potassium and sodium dichloroisocyanurates, potassium and sodium trichlorocyanurates, N-chloroimides, N-chloroamides, N-chloroamines and chlorohydantoins.

Limescale reducing agents herein include, but are not limited to acids and chelating agents. Exemplary acids useful herein include hydrochloric acid, phosphoric acid, sulfuric acid, sulfamic acid, acetic acid, hydroxyacetic acid, citric acid, benzoic acid, tartaric acid, formic acid and mixtures thereof. A mixture of organic and inorganic acid is preferred. Chelating agents useful herein can include, but are not limited to, carboxylates, phosphates, phosphonates, polyfunctionally-substituted aromatic compounds, polyamines, biodegradable compounds, the alkali metal, ammonium or substituted ammonium salts or complexes of these chelating agents, and mixtures thereof. Further examples of suitable chelating agents and levels of use are described in U.S. Pat. Nos. 3,812,044; 4,704,233; 5,292,446; 5,445,747; 5,531,915; 5,545,352; 5,576,282; 5,641,739; 5,703,031; 5,705,464; 5,710,115; 5,710,115; 5,712,242; 5,721,205; 5,728,671; 5,747,440; 5,780,419; 5,879,409; 5,929,010; 5,929,018; 5,958,866; 5,965,514; 5,972,038; 6,172,021; and 6,503,876.

Biocide means any known ingredient having the ability of reducing or even eliminating by killing or removing the micro-organisms existing on a surface, such as those described in U.S. Pat. No. 6,613,728. Biocide useful herein includes a quaternary surface active compound, a guanidine, an alcohol, a glycerol, a phenolic compound, a heavy metal salt, an inorganic and organic acid, a halogen, a halogen-containing compound, a dye, an essential oil, an oxidizing compound, an adsorbent, a fungicide, an algaecide and a mixture thereof. Exemplary quaternary surface active compounds include benzalkonium chloride, benzethonium chloride, cetyl pyridinium chloride, sodium tetradecyl sulfate, sichlorobenzalkonium chloride, methylbenzethonium chloride, cetyl dimethyl ethyl ammonium bromide. Exemplary guanidines include chlorohexidine hydrochloride, chlorohexidine gluconate, dodecylguanidine hydrochloride, polyhexmethylenebiguanidine hydrochloride, and 6-acetoxy-2,4-dimethylmetadioxane. Exemplary alcohols include methanol, ethanol, propanol, isopropanol, etc. Exemplary phenolic compounds include cresol, resolcinols and related compounds, phenol; substituted phenols—cresols, meta-cresylacetate, creosote, quaiacol, resorcinol, hexylresorcinol, pyrogallol, thymol, thymol iodide, picric acid, chlorinated phenols—dichlorophene, hexachlorophene, tars. Exemplary halogens and halogen-containing compounds include iodine and iodoform. Exemplary oxidizing agents include peroxide, sodium perporate, potassium permanganate, zinc permanganate, potassium chlorate. Exemplary heavy metal salts include mercuric chloride, miscellaneous ionizable mercuric salts, organic mercurials, silver nitrate, silver lactate, silver picrate, silver proteins, silver halides, zinc oxide, zinc stearate, copper sulfate and organic tin derivatives. Exemplary dyes include azo dyes, acridene dyes, fluorescein dyes, phenolphthalein dyes and triphenylmethane dyes. Exemplary inorganic and organic acids include hydrochloric acid, sulfuric acid, nitric acid, citric acid, sorbic acid, acetic acid, boric acid, formic acid, maleic acid, adipic acid, lactic acid, malic acid, malonic acid, glycolic acid, and mixtures thereof. Exemplary essential oils are thyme oil, clove oil, cinnamon oil, geranium oil, eucalyptus oil, peppermint oil, citronella oil, ajowan oil, mint oil or mixtures thereof. Other useful biocide herein includes furan derivatives, nitrofurantoin, sulfur, sulfur dioxide, ichthamol, chrysarobin, anthralin, betanaphthol, balsams, volatile oils, chlorophyl.

Biocides useful herein also include fungicides and algaecides which act against molds and mildew. Removal of algae and fungi from hard surfaces is difficult. Moreover, fungi and algae reappear promptly if not completely removed or inhibited. Suitable fungicides and algaecides include metal salts, such as zinc sulfate, zinc acetate, zinc bromide, zinc chloride, zinc iodide, zinc nitrate, zinc bromate and zinc chlorate, cooper halide, copper sulfate, organic tin derivatives, water-insoluble or partially water-soluble fungicides and algaecides, such as diiodomethyl p-tolyl sulfone, N-(trichloromethyl thio) phthalimide, N,N-dimethyl-N'-phenyl N'-(fluorodichloromethyl thio) sulphamide, 2-(thiocyanomethylthio) benzothiazole/methylene bis(thiocyanate), 3-iodo-2-propynyl butyl carbamate, etc., all available from ALDRICH chemical. Above biocides are optionally mixed with concentrated acids, such as acetic acid, formic, propionic, n-butanoic, n-pentanoic, trimethylacetic, n-hexanoic, lactic, methoxyacetic, cyanoacetic, chloroacetic, citric, partaric, etc.

Active agent can be a solvent having a good dissolving ability for greasy stains. Solvents useful herein include those which are at least partially water-miscible, such as alcohols, ethers, such as diethylene glycol diethylether, diethylene glycol dimethylether, propylene glycol dimethylether, propylene glycol monomethylether, propylene glycol monoethylether, propylene glycol monopropylether, propylene glycol monobutylether, ethylene glycol monobutylether, dipropylene glycol monomethylether, dipropylene glycol monopropyl ether, dipropylene glycol monobutyl ether, diethyleneglycol monobutylether, lower esters of monoalkylethers of ethylene glycol or propylene glycol, such as propylene glycol monomethyl ether acetate, N-methyl pyrolidone and tetrahydrofuran. Mixtures of several solvents can also be used.

Packaging Means

The cleaning implement herein may be combined in an article of manufacture with a packaging means known for packaging cleaning implements. Particularly suitable packaging means herein can be paper bags, plastic bags, cartons, carton boxes, flow wraps, plastic wraps, and paper wraps, and the like and combinations thereof.

Method of Cleaning a Hard Surface

In another embodiment, the present invention encompasses method of cleaning a hard surface with a cleaning implement herein. In yet another embodiment, the present invention encompasses a method of cleaning a hard surface by bringing a cleaning implement herein into contact with said hard surface. "Cleaning" means removing spots and/or stains from hard surfaces.

Suitable hard surfaces herein are tiles, walls, floors, sanitary fittings such as sinks, showers, shower curtains, wash basins, WCs, household appliances including, but not limited to, refrigerators, freezers, washing machines, automatic dryers, ovens, microwave ovens, dishwashers and so on.

The methods of cleaning a hard surface herein may additionally include the step of wetting said cleaning implement with an appropriate solvent, preferably tap water, prior to bringing said cleaning implement into contact with said hard surface.

The present invention is further illustrated by the following examples. In all the following examples, the erodible foam substrate is an open-cell foam having an open-cell factor of 99.6% according to DIN ISO 4590, a density of 10.0 kg/m$^3$ determined according to EN ISO 845, an average pore diameter of 210 μm determined via evaluation of micrographs of sections and a BET surface area of 6.4 m$^2$/g determined according to DIN 66131. The open-cell foam is commercially available as Basotec™ melamine foam from BASF. All the melamine foam substrate and any additional substrate(s), if present, have a cuboid shape with a length of about 125 mm and a width of about 65 mm.

Examples 1-8

A controlled release system comprising a low melting hotmelt polymer matrix and an active agent is prepared by mixing the compositions shown in below Table 1 in a high-shear hotmelt blender (TM 20 twin screw extruder from Maris, Torino, Italy). All the percentages in the table are by weight based on the total weight of the controlled release system. About 1.5 g of the controlled release system is extruded onto the surface of a melamine foam substrate having a thickness of about 23 mm and weighted about 1.85 g in a series of separate lanes at about 70° C. by a slot-coating nozzle (EP-11 from Nordson Germany or an LH-3 laboratory coater/laminator from Acumeter USA). After applying the melted controlled release system onto the melamine foam substrate, a second substrate of an open-cell polyurethane foam (Sweetane™ series by Recticel) having a thickness of about 6 mm is adhered to the melamine foam substrate along the surface coated with the controlled release system by a liquid-impermeable polyamide hotmelt adhesive (Fullback™ from Fuller). After the adherence of the two substrates, the substrates are squeezed for a few times or heated to a higher temperature to facilitate the penetration of the controlled release system into the melamine foam substrate and polyurethane foam substrate. Cleaning implements having a controlled release system located at the interface of a melamine foam substrate and an open-cell polyurethane foam substrate are obtained.

TABLE 1

| | 1 | 2 | 3 | 4 | 5 | 6 | 7 | 8 |
|---|---|---|---|---|---|---|---|---|
| Elvax ™ 250[1] | 30% | | | | | | | |
| Pebax ™ MH1657[2] | | 30% | | | | | | |
| Hytrel ™ 8171[3] | | | 30% | | | | | |
| Estane ™ 5170[4] | | | | 30% | | | | |
| Pluriol ™ E9000[5] | | | | | 65% | 65% | 65% | 65% |
| Foralyn ™ 5020F[6] | 15% | 15% | 15% | | | | | |
| Kristalex ™ F85[7] | 5% | | | | | | | |
| acetyltributylcitrate | 10% | | | | | | | |
| triethylcitrate | | 15% | | | | | | |
| Diacetin | | | 15% | 15% | | | | |
| Pluriol ™ E400[5] | | | | 20% | | | | |
| Lutensol ™ XL70[8] | 40% | | | | | | | |
| Lutensol ™ XL 80[9] | | 40% | | | | | | |
| Lutensol ™ XL 100[10] | | | 40% | | | | | |
| Plurafac ™ LF 901[11] | | | | 35% | 35% | | | 15% |
| N,N-phthaloylaminoperoxy caproic acid | | | | | | 35% | | |
| Sodium hypochlorite | | | | | | | 35% | |
| Cetyl pyridinium chloride | | | | | | | | |
| Propylene glycol n-butylether | | | | | | | | 20% |

[1]ethylene-vinyl acetate copolymer from DuPont

[2]polyether-block amides polymer from Atofina Chemicals

[3]polyether-polyester block copolymer from DuPont

[4]thermoplastic elastic polyurethane from Noveon

[5]polyethylene glycol from BASF

[6]rosin ester tackifier from Eastman Chemical

[7]α-methylstyrene copolymer hydrocarbon resin tackifier from Hercules

[8]$C_{10}$ alkyl polyethelene glycol ether with a degree of ethoxylation of 7 from BASF

[9]$C_{10}$ alkyl polyethelene glycol ether with a degree of ethoxylation of 8 from BASF

[10]$C_{10}$ alkyl polyethelene glycol ether with a degree of ethoxylation of 10 from BASF

[11]nonionic straight chain primary oxyethylated alcohol from BASF

Examples 9-16

A liquid controlled release system comprising a polymer matrix and an active agent is prepared by mixing the compositions shown in Table 2. All the percentages in Table 2 are by weight based on the controlled release system. About 1 g of the liquid controlled release system is sprayed onto the surfaces of two melamine foam substrates each having a thickness of about 10 mm using an A7A spray guns or AD handgun from Nordso. The melamine foam substrates weight about 0.8 g each before applying the controlled-release system. Adhere the controlled release system-coated surfaces of the melamine foam substrates to a third substrate of closed-cell polypropylene foam (from Zotefoam, UK) having a thickness of about 10 mm in a sandwiched configuration. Said third substrate is adhered in-between the two melamine foam substrates by a polyamide hotmelt (commercially available as liquid-impermeable Fullback™ hotmelt adhesive from Fuller). The three-ply laminate is then manually compressed to allow the penetration of the controlled release system into the melamine foam substrates. The cleaning implements thus obtained are then air dried to evaporate water and ethanol.

TABLE 2

| | 9 | 10 | 11 | 12 | 13 | 14 | 15 | 16 |
|---|---|---|---|---|---|---|---|---|
| PEG-polyvinyl acetate solution[1] | 70% | | 70% | | 70% | | 70% | |
| Mowiol ™ 40-88 solution[2] | | 70% | | 70% | | 70% | | 70% |
| Alkyl polyethylene glycol ether | 20% | | | | | | | |
| Cetyl dimethyl amine oxide | 10% | | | | | | | |
| Nonionic straight chain primary oxyethylated alcohol | | 20% | | | | | | |
| Sodium dodecyl benzene sulfonate[3] | | 10% | | | | | | |
| N,N-phthaloylaminoperoxy caproid acid | | | 30% | 30% | | | | |
| Sodium hypochlorite | | | | | 30% | 30% | | |
| Cetyl pyridinium chloride | | | | | | | 30% | 30% |

[1]A viscous solution mixture containing 70% by weight of polyethylene glycol grafted with vinyl acetate, 20% by weight of ethanol and 10% by weight of water
[2]A viscous solution mixture available from Harlow Chemical Company Ltd containing 60% by weight of polyvinyl alcohol (88% of which is hydrolyzed), 10% by weight of ethanol and 30% by weight of water
[3]Nacconol ™ available from Stepan Examples 17-19

A controlled release system comprising beta-cyclodextrin particles having an average particle size of about 150 microns, water and an active agent is prepared by mixing and stirring compositions shown in Table 3 for four hours to give a suspension. The suspension is then sprayed onto the surface of a melamine foam substrate having a thickness of about 14 mm and weighting about 1.1 g before loaded with the controlled-release system. The melamine foam substrate is then attached to a second melamine foam substrate of equal thickness using Fullback™ adhesive from Fuller. Cleaning implements are thus obtained.

TABLE 3

| | 17 | 18 | 19 |
|---|---|---|---|
| Beta-cyclodextrin[1] | 1 g | 1 g | 1 g |
| Water | 5 ml | 5 ml | 5 ml |
| Nonionic surfactant[2] | 0.25 g | | |
| N,N-phthaloylaminoperoxycaproic acid | | 0.25 g | |
| Cetyl pyridinium chloride | | | 0.25 g |

[1]Cavamax W7 from Wacker
[2]Neodol 91-8, a $C_{9-11}$ alkyl polyethylene glycol surfactant with an ethoxylation degree of about 8 from Shell Example 20

A particulate porous carrier mixture of 0.15 g Zeolite A and 0.15 g mesoporous silica ZSM-5 having a particle size of about 150 microns is deposited into one of the two largest surfaces of a melamine foam substrate having a thickness of about 14 mm and weighting about 1.1 g before loaded with the controlled-release system. A mixture of active agent comprising 0.067 g nonionic $C_{12-13}$ primary alcohol ethoxylate surfactant with an ethoxylation of about 3 (Neodol™ 23-3 from Shell), 0.033 g cocoamidopropyl betaine surfactant (Amphosol™ from Stepan) and 1 g water is then sprayed onto the zeolite/silica particles deposited on the surface of the melamine foam substrate. A second melamine foam substrate of about equal thickness is then adhered to the active agent-loaded surface of the first melamine foam substrate by Fullback™ adhesive. Cleaning implements with a controlled release system of particulate porous carrier and active agent located across the interface of the two melamine foam substrates are thus obtained.

Examples 21-22

Same steps to Example 20 are repeated, except that the mixture of active agent is 0.1 g N,N-phthaloylaminoperoxycaproic acid dissolved in 1 g water (Example 21) and 0.1 g cetyl pyridinium chloride dissolved in 1 g water (Example 22).

Example 23

A controlled release system is prepared by mixing 0.3 g polyethyleneimine (Lupasol™ from BASF) and 0.15 g Nacconol™ in 5 ml water to form a suspension. The suspension is then deposited into one of the two largest surfaces of a melamine foam substrate having a thickness of about 14 mm and weighting about 1.1 g before loaded with the controlled-release system. A second melamine foam substrate of about equal thickness and weight is then adhered to the controlled release system-loaded surface of the first melamine foam. A cleaning implement is thus obtained.

Example 24

Active agent described in the above examples is sprayed at an amount of about 25 g/m$^2$ onto a polyethylene film having a basis weight of 30 g/m$^2$ from Tacolin or Clopay. The active agent-loaded polyethylene film is then laminated to another virgin polyethylene film with ultrasonic discontinuous bonding pattern followed by needle punching treatment with 1 mm-diameter needles at a pore density of 1500 pores/$m^2$ (needle punching treatment may be conducted prior to ultrasonic lamination). The punched laminated polyethylene films are then laminated between two melamine foam substrates each having a thickness of 14 mm and weighting about 1.1 g before loaded with the controlled-release system. Cleaning implements are thus obtained.

Example 25

Same steps to Example 24 are taken except that polyethylene films are replaced with polypropylene nonwoven (100% PP Melten 65 g/$m^2$ SMS from Tenotext).

Example 26

Same steps to Example 24 are taken except that one of the polyethylene films is not subject to needle-punching treatment and the polyethylene film laminates is then laminated between a melamine foam substrate having a thickness of about 23 mm and weighting about 1.85 g before applying the controlled-release system and an open-cell polyurethane foam substrate (Sweetane™ series by Recticel™) having a thickness of about 6 mm, wherein the unpunched film is attached to the polyurethane foam substrate.

Example 27

Same steps to Example 26 are taken except that the needle-punched polyethylene film is replaced with a microporous polyethylene film (HBBS 40 g/$m^2$ MD stretched from RKW AG).

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments herein have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning implement, comprising four layers of substrate in a sandwiched configuration, wherein an erodible foam substrate is positioned as both of the outside layers attached to two middle layers by adhesion, wherein (a) the erodible foam substrate comprises from about 5% to about 20% by weight of an active agent in free form; and (b) an aqueous controlled release system comprising:

(i) a remainder of said active agent, and (ii) a hotmelt polymer matrix consisting essentially of an effective amount of water-soluble polyethylene glycol having an average molecular weight in the range of from 1,500 to 9,000 g/mol, wherein said active agent is selected from the group consisting of a surfactant, a bleaching agent, a limescale reducing agent, a biocide, a solvent, and a mixture thereof and is released from said controlled release system by an activation means selected from the group consisting of: water activation, degradation, friction, and combinations thereof, wherein the aqueous controlled release system is applied in-between the two middle layers.

2. The cleaning implement of claim 1, wherein said aqueous controlled release system comprises a first semi-permeable film and a second film of a semi-permeable film or a liquid-impermeable film, and wherein said active agent is applied in-between the first semi-permeable film and the second film.

3. The cleaning implement of claim 1, wherein the two middle layers are closed-cell foam substrates of a polymer comprising a monomer selected from the group consisting of a urethane, a propylene, an ethylene, a vinyl acetate, an ester and a mixture thereof.

4. The cleaning implement of claim 3, wherein said aqueous controlled release system comprising an active agent is contained in said adhesive attachment.

5. The cleaning implement of claim 1, wherein said two middle layers are liquid-impermeable layers.

6. A method of cleaning a hard surface by bringing a cleaning implement of claim 1 into contact with said hard surface.

7. The method of cleaning a hard surface of claim 6, wherein said method additionally includes the step of wetting said cleaning implement with an appropriate solvent prior to bringing said cleaning implement into contact with said hard surface.

8. The method of cleaning a hard surface according to claim 7, wherein said appropriate solvent is water.

* * * * *